US006521091B2

(12) United States Patent
Bubik et al.

(10) Patent No.: US 6,521,091 B2
(45) Date of Patent: Feb. 18, 2003

(54) TWIN WIRE FORMER

(75) Inventors: Alfred Bubik, Ravensburg (DE); Joachim Henssler, Ravensburg (DE); Jürgen Prössl, Horgenzell (DE); Mathias Schwaner, Ravensburg (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/804,947

(22) Filed: Mar. 13, 2001

(65) Prior Publication Data

US 2002/0096297 A1 Jul. 25, 2002

(30) Foreign Application Priority Data

Mar. 14, 2000 (DE) ..... 100 12 342

(51) Int. Cl.[7] ..... D21F 1/00
(52) U.S. Cl. ..... 162/203; 162/301
(58) Field of Search ..... 162/109, 111, 162/123, 198, 203, 212, 216, 300, 301, 363, 367, 368, 370

(56) References Cited

U.S. PATENT DOCUMENTS 3,729,374 A 4/1973 Lissalde ..... 162/203
3,847,731 A * 11/1974 Arledter ..... 162/203
4,209,360 A * 6/1980 Stenberg et al. ..... 162/203
5,480,513 A * 1/1996 Niskanen et al. ..... 162/203
5,593,545 A * 1/1997 Rugowski et al. ..... 162/207
5,785,816 A 7/1998 Schaible ..... 162/203
5,798,024 A * 8/1998 Odell et al. ..... 162/203

FOREIGN PATENT DOCUMENTS

EP 0 335 821 A2 10/1989 ..... D21F/9/00
EP 0 504 123 A1 9/1992 ..... D21F/9/00
WO WO 97/47803 12/1997 ..... D21F/1/00

* cited by examiner

*Primary Examiner*—Steven P. Griffin
*Assistant Examiner*—Eric Hug
(74) *Attorney, Agent, or Firm*—Taylor & Aust, P.C.

(57) ABSTRACT

A twin wire former in a machine for the production of a fibrous material web, specifically a paper or cardboard web, includes two rotating continuous wires which meet in the area of a simultaneously rotating dewatering element, thereby forming a stock inlet gap; and a headbox over which the fiber stock suspension is fed into the stock inlet gap. The stock consistency C of the fiber stock suspension in the headbox, as well as the basis weight F of the fiber stock suspension supplied to the stock inlet gap is selected according to the calculation:

$$F/(C*1000)>0.025$$

whereby the basis weight F is stated in g/m$^2$ and the stock consistency C is stated in g/l.

16 Claims, 1 Drawing Sheet

TWIN WIRE FORMER

BACKGROUND OF THE INVENTION

1. Field of the Invention

The present invention relates to a twin wire former for the production of a fibrous material web, specifically a paper or cardboard web.

2. Description of the Related Art

A twin wire former having two rotating continuous wires which meet in the area of a simultaneously rotating dewatering element which thereby form a stock inlet gap; and a headbox from which the fiber stock suspension is fed into the stock inlet gap is described in PCT publication WO 97/47803.

SUMMARY OF THE INVENTION

The present invention provides a twin wire former which provides the highest possible web strength, soft-flake web structure, and an optimal streak-free formation.

The consistency of packaging paper and cardboard is dependent upon the volume of water which is removed on the forming roll of a former. Contrary to theoretical assumptions it has been demonstrated that a larger forming roll diameter with the same angle of wrap results in a higher dewatering capacity than a smaller diameter forming roll.

As the forming roll diameter is increased, the maximum thickness of the suspension jet exiting the headbox may also increase, without concern for backflows at the stock inlet gap.

Additionally, the achievable dimensional ratio (L/h) between jet length L and stream height h decreases with increasing suspension jet thickness which manifests itself in a streak-free formation, without significant influence of the boundary layer turbulence of the headbox walls.

The current invention creates a twin wire former of the type described at the beginning of this document with which, under consideration of the aforementioned factors the highest possible web strength, an optimum streak-free formation and an optimum soft-flake web structure is achieved.

According to the invention, the stock consistency C of the fibrous stock suspension in the headbox, as well as the basis weight F of the fibrous stock suspension supplied into the stock inlet gap is selected according to the calculation:

$$F/(C*1000)>0.025$$

whereby the basis weight F is stated in g/m$^2$ and the stock consistency C is stated in g/l.

The ratio between the maximum length of the suspension jet flowing between the discharge slice of the headbox and the stock inlet gap and the thickness of the free suspension jet is preferably smaller than 10.

If the discharge slice of the headbox is located, for example between two nozzle walls and/or one or more separating elements which are positioned transversely to the direction of the stream and one is offset from the other, then the maximum length of the free suspension jet may be determined by the distance between the set back nozzle wall and the point at which the suspension jet segment, on the side of the offset nozzle wall, impacts the relevant wire.

The dewatering element may for example be formed by a roll or by a rotating belt or fabric which would preferably be guided over curved elements. The respective roll may have an open or closed surface. It may be operated with or without vacuum. The respective belt or fabric may be specifically an open belt or fabric.

One or more formation elements and/or one or more dewatering elements may be provided following the dewatering or forming element.

In a suitable, practical embodiment of the twin wire former according to the invention, the dewatering element around which both wires wrap, has a curvature radius in the wrap-around area which is equal to or larger than approximately 900 mm and preferably larger than approximately 1000 mm. If the dewatering element is a roll, then the roll diameter is preferably greater than or equal to approximately 1800 mm, and more preferably greater than approximately 2000 mm.

It is also an advantage if the convergence angle which is formed between one of the two transverse nozzle walls and the direction of jet flow is greater than or equal to approximately 1°.

On one of the curved dewatering elements wrapped by the two wires, the ratio between the radius of curvature and the thickness of the free suspension jet is preferably less than approximately 45, and more preferably less than approximately 35.

It is also an advantage if the length of wrap X over which the two wires wrap around the dewatering element, and the thickness h of the free suspension jet are selected so that the value resulting from the equation $\sqrt{(X*h)}$ is in the range of approximately 140 mm to approximately 300 mm and preferably in a range of between approximately 160 mm and approximately 300 mm.

The wire speed v, the wire tension T and the density ρ of the fiber stock suspension are appropriately designed to result in the following:

$$\frac{T}{h*\rho*v^2}>1$$

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
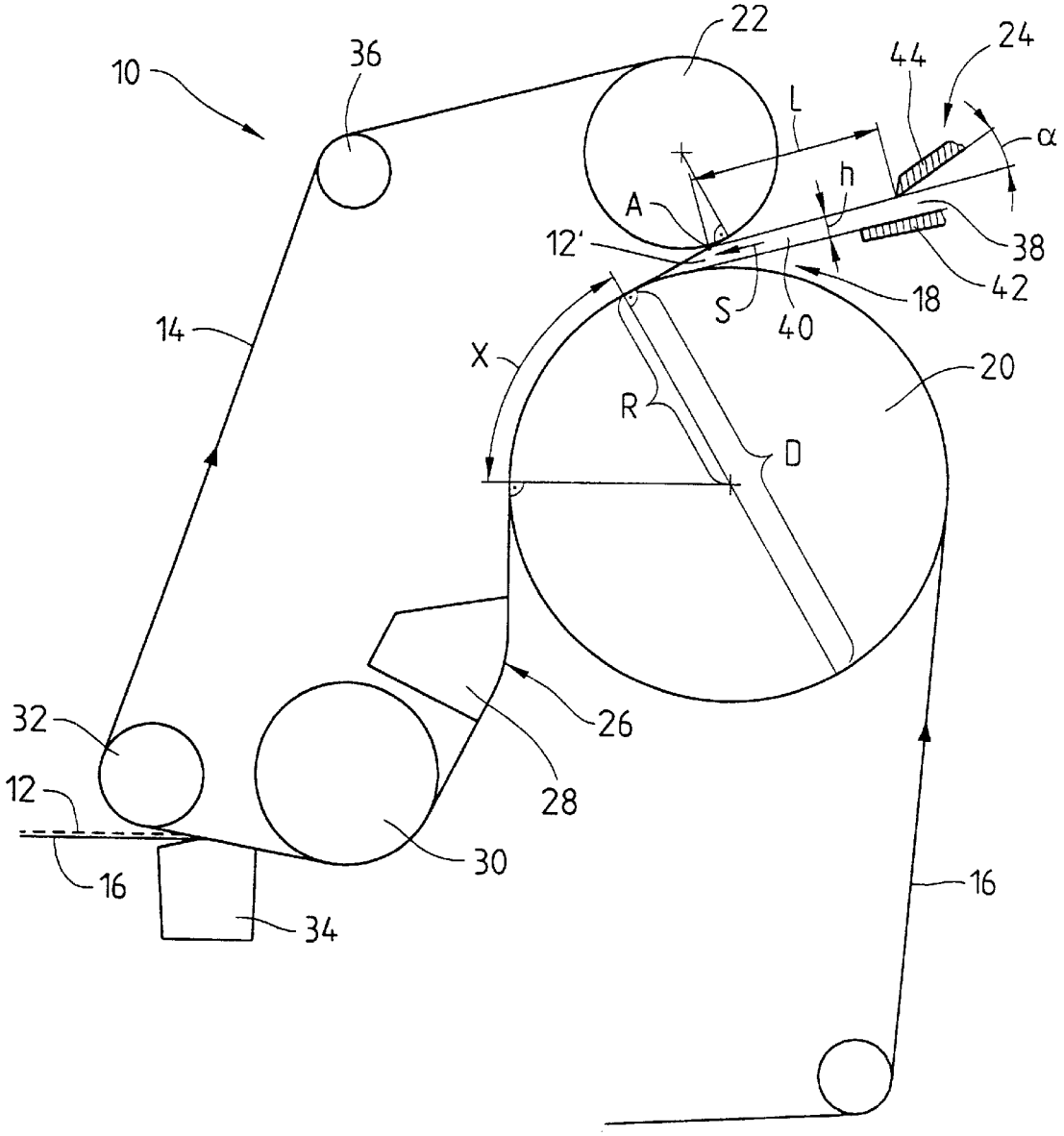
FIG. 1 is a schematic illustration of an embodiment of a twin wire former of the present invention.

Referring now to the drawing, and more particularly to FIG. 1, there is shown a schematic drawing of an embodiment of a twin wire former 10 for the production of a fibrous material web 12, which may specifically be paper or cardboard.

Twin wire former 10 includes two rotating continuous wires 14 and 16 which meet in the area of a simultaneously rotating dewatering or forming element 20, the meeting of which form a stock inlet gap. Dewatering element 20 may for example be a forming roll or a forming belt or fabric which is supported by blades.

Outer wire 14 which does not come into direct contact with dewatering element 20 is led over a breast roll 22 in the area of stock inlet gap 18.

Fiber stock suspension 12' is supplied to stock inlet gap 18 from headbox 24.

Along the twin wire travel path 26, following dewatering element 20, which in this example is a forming roll, additional elements 28 and 30 assist in the forming and/or the dewatering process.

Following element 30, outer wire 14 travels over turning roll 32, which effectively separates it from inside wire 16 which continues to support fiber stock web 12. In order to ensure that fiber stock web 12 remains adhered to inside wire 16 and is appropriately transported, an additional separating element may be provided.

Outer wire 14 is returned to breast roll 22 by running over an additional turning roll 36.

The stock consistency C of fiber suspension 12' in headbox 24, as well as the basis weight F of fiber suspension 12' supplied to stock inlet gap 18 is selected according to the following formula:

$$F/(C*1000)>0.025$$

whereby the basis weight F is expressed in g/m$^2$ and the stock consistency C in g/l.

The ratio between the maximum length L of the suspension jet flowing freely between discharge slice 38 of headbox 24 and stock inlet gap 18, and the thickness h of free suspension jet 40 is preferably less than 20 and more preferably less than 10.

Discharge slice 38 of headbox 24 is located for example between nozzle wall 42 and nozzle wall 44 which are positioned transversely to the direction of travel of stream S whereby the top nozzle wall 44 is offset from the bottom nozzle wall 42. The maximum length L of free suspension jet 40 may be determined by the distance between nozzle wall 44 and the point of impact A at which the suspension jet segment on the side of top nozzle wall 44 impacts outer wire 14.

Dewatering element 20 around which both wires 14 and 16 wrap, has a curvature radius R in the wrap around area X, which is effectively greater than or equal to approximately 900 mm and preferably greater than approximately 1000 mm. In the present example the dewatering element 20 is a roll. The roll diameter D is therefore effectively greater than or equal to approximately 1800 mm, and preferably greater than approximately 2000 mm.

The convergence angle a formed between top nozzle wall 44 and the direction of the jet flow S is preferably larger than or equal to approximately 1°.

The ratio between the curvature radius R of the dewatering element 20 in the wrap-around area X and the thickness h of the free suspension jet 40 is preferably less than approximately 45 and more preferably less than approximately 35. Since dewatering element 20 in the present example features a roll, the curvature radius R is equal to the roll radius.

The length of the wrap X over which the two wires 14, 16 wrap around dewatering element 20, and the thickness h of free suspension jet 40 are selected preferably so that the value resulting from the equation $\sqrt{(X*h)}$ is in the range of approximately 140 mm to approximately 300 mm and preferably in a range of between approximately 160 mm and approximately 300 mm.

The wire speed v, the wire tension T and the density ρ of fiber stock suspension 12' are effectively designed to result in the following relationship:

$$\frac{T}{h*\rho*v^2}>1$$

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

Component Identification Index

10 Twin wire former
12 Fiber stock web
12' Fiber stock suspension
14 Outer wire
16 Inner wire
18 Stock inlet gap
20 Simultaneously rotating dewatering element
22 Breast roll
24 Twin wire
26 Twin wire travel path
28 Forming or dewatering element
30 Forming or dewatering element
32 Turning roller
34 Separating element
36 Turning roller
38 Discharge slice
40 Free suspension jet
42 Nozzle wall
44 Nozzle wall
h Thickness of the free suspension jet
A Point of impact
D Roll diameter
L Maximum length of the free suspension jet
R Curvature radius, roll radius
S Direction of jet flow
X Wrap-around area, wrap-around length

What is claimed is:

1. A method of producing a fibrous material web using a twin wire former, said method comprising the steps of:

providing a twin wire former having a rotating dewatering element being a roll of diameter D greater than or equal to approximately 1800 mm, a set of two counter rotating continuous wires defining a stock inlet gap therebetween, and a headbox including a discharge slice;

selecting a source of fiber stock suspension to be supplied to said headbox according to the calculation:

$$F/(C*1000)>0.025$$

where F is the basis weight in g/m$^2$ of the fiber stock suspension supplied to said stock inlet gap and C is the stock consistency in g/l of the fiber stock suspension in said headbox;

feeding the fiber stock suspension through said discharge slice producing a suspension jet of thickness h into said stock inlet gap, said rotating dewatering element being curved, having a curvature radius R, a distance said continuous wires have contact with said rotating dewatering element being X and the ratio of R to h being less than approximately 45, wherein a length over which said continuous wires have contact with said rotating dewatering element X and h are selected so that the value resulting from the equation $\sqrt{(X*h)}$ is in the range of between approximately 140 mm and approximately 300 mm; and operating said twin wire former using said fiber stock suspension to produce the fibrous material web.

2. The method of producing a fibrous material web using a twin wire former of claim 1, including the steps of:

selecting a thickness h of the suspension jet, a velocity v of said continuous wires, a tension T of said continuous wires, and a density ρ of the fiber stock suspension such that the following equation is true:

$$\frac{T}{h*\rho*v^2} > 1$$

3. A twin wire former for the production of a fibrous material web, comprising:

a rotating dewatering element being a roll of diameter D greater than or equal to approximately 1800 mm;

a set of two counter rotating continuous wires meeting in an area of said rotating dewatering element and forming a stock inlet gap therebetween;

a headbox including a discharge slice, said headbox configured to feed a fiber stock suspension through said discharge slice producing a suspension jet of thickness h into said stock inlet gap, said rotating dewatering element being curved, having a curvature radius R, a distance said continuous wires have contact with said rotating dewatering element being X and the ratio of R to h being less than approximately 45, wherein a length over which said continuous wires have contact with said rotating dewatering element X and h are selected so that the value resulting from the equation $\sqrt{(X*h)}$ is in the range of between approximately 140 mm and approximately 300 mm; and a source of fiber stock suspension to be supplied to said headbox selected according to the calculation:

$$F/(C*1000)>0.025$$

where F is the basis weight in g/m$^2$ of the fiber stock suspension supplied to said stock inlet gap and C is the stock consistency in g/l of the fiber stock suspension in said headbox.

4. The twin wire former of claim 3, wherein said headbox is adjustable such that the ratio of the maximum length L of a suspension jet flowing from said discharge slice and h is less than 20.

5. The twin wire former of claim 4, wherein said ration of L to h is less than 10.

6. The twin wire former of claim 4, wherein said headbox includes an upper nozzle wall and a lower nozzle wall positioned transversely to the direction of flow of the suspension jet and defining said discharge slice therebetween, said lower nozzle wall being offset relative to said upper nozzle wall whereby L is determined by the distance from said upper nozzle wall and the point of impact of the top of the suspension jet with one of said continuous wires.

7. The twin wire former of claim 4, wherein said headbox includes an upper nozzle wall and a lower nozzle wall positioned transversely to the direction of flow of the suspension jet and defining said discharge slice there between, said upper nozzle wall being configured such that the angle a formed between the suspension jet and said upper nozzle wall is greater than or equal to approximately 1°.

8. The twin wire former of claim 3, wherein the value resulting from said equation $\sqrt{(X*h)}$ is in the range of between approximately 160 mm and approximately 300 mm.

9. The twin wire former of claim 4, wherein a traveling velocity v of said continuous wires, a tension T of said continuous wires, a density ρ of the fiber stock suspension and h selected such that the following equation is true:

$$\frac{T}{h*\rho*v^2} > 1$$

10. The twin wire former of claim 3, wherein said rotating dewatering element is a roll.

11. The twin wire former of claim 3, wherein said rotating dewatering element includes at least one curved element and a revolving belt running over said at least one curved element.

12. The twin wire former of claim 3, wherein said rotating dewatering element is curved having a curvature radius R effectively greater than or equal to approximately 900 mm.

13. The twin wire former of claim 12, wherein said curvature radius R is greater than approximately 1,000 mm.

14. The twin wire former of claim 3, wherein said diameter D is greater than approximately 2,000 mm.

15. A twin wire former for the production of a fibrous material web, comprising:

a rotating dewatering element being a roll of diameter D greater than or equal to approximately 1800 mm;

a set of two counter rotating continuous wires meeting in an area of said rotating dewatering element and forming a stock inlet gap therebetween;

a headbox including a discharge slice, said headbox configured to feed a fiber stock suspension through said discharge slice producing a suspension jet of thickness h into said stock inlet gap, said headbox is adjustable such that the ratio of the maximum length L of a suspension jet flowing from said discharge slice and h is less than 20, said rotating dewatering element being curved, having a curvature radius R, a distance said continuous wires have contact with said rotating dewatering element being X and the ratio of R to h being less than approximately 45, wherein a length over which said continuous wires have contact with said rotating dewatering element X and h are selected so that the value resulting from the equation $\sqrt{(X*h)}$ is in the range of between approximately 140 mm and approximately 300 mm; and a source of fiber stock suspension to be supplied to said headbox selected according to the calculation:

$$F/(C*1000)>0.025$$

where F is the basis weight in g/m$^2$ of the fiber stock suspension supplied to said stock inlet gap and C is the stock consistency in g/l of the fiber stock suspension in said headbox.

16. The twin wire former of claim 15, wherein said ration of R to h is less than approximately 35.

* * * * *

UNITED STATES PATENT AND TRADEMARK OFFICE

CERTIFICATE OF CORRECTION

PATENT NO. : 6,521,091 B2
DATED : February 18, 2003
INVENTOR(S) : Bubik et al.

It is certified that error appears in the above-identified patent and that said Letters Patent is hereby corrected as shown below:

Column 3,
Line 51, delete “angle a”, and substitute therefor -- angle α --.

Column 6,
Lines 2 and 3, delete “there between”, and substitute therefore -- therebetween --;
Line 4, delete “angle a”, and substitute therefor -- angle α --; and
Line 64, delete “ration”, and substitute therefore -- ratio --.

Signed and Sealed this

Twenty-seventh Day of July, 2004

JON W. DUDAS
*Acting Director of the United States Patent and Trademark Office*